US008689510B1

(12) United States Patent
Krumvieda

(10) Patent No.: US 8,689,510 B1
(45) Date of Patent: Apr. 8, 2014

(54) ROOFING SYSTEM AND METHOD

(76) Inventor: Aaron G. Krumvieda, Sioux Falls, SD (US)

( * ) Notice: Subject to any disclaimer, the term of this patent is extended or adjusted under 35 U.S.C. 154(b) by 0 days.

(21) Appl. No.: 13/430,836

(22) Filed: Mar. 27, 2012

(51) Int. Cl.
*E04D 11/00* (2006.01)

(52) U.S. Cl.
USPC ..... 52/516; 52/528

(58) Field of Classification Search
USPC ..... 52/516, 518, 519, 554, 557, 558, 559, 52/555, 314, 409, 528, 748.1
See application file for complete search history.

(56) References Cited

U.S. PATENT DOCUMENTS

| | | | | | |
|---|---|---|---|---|---|
| 776,198 | A * | 11/1904 | Odell | 52/557 |
| 800,320 | A * | 9/1905 | Odell | 52/518 |
| 1,596,272 | A * | 8/1926 | Jordan | 52/521 |
| 1,897,139 | A * | 2/1933 | Overbury | 156/93 |
| 1,939,004 | A * | 12/1933 | Fischer | 428/41.7 |
| 2,044,788 | A * | 6/1936 | Ochs et al. | 52/419 |
| 2,847,948 | A * | 8/1958 | Truitt | 428/189 |
| 3,336,179 | A * | 8/1967 | Campbell et al. | 428/300.7 |
| 3,774,428 | A | 11/1973 | Derry | |
| 3,913,294 | A * | 10/1975 | Freiborg | 52/518 |
| 4,226,070 | A * | 10/1980 | Aragon | 52/57 |
| 4,287,241 | A | 9/1981 | Kaufmann | |
| 4,848,045 | A * | 7/1989 | Nichols et al. | 52/60 |
| 5,037,685 | A * | 8/1991 | Richards et al. | 428/40.5 |
| 5,050,357 | A * | 9/1991 | Lawson | 52/314 |
| 5,548,940 | A * | 8/1996 | Baldock | 53/430 |
| 5,671,577 | A * | 9/1997 | Todd | 52/519 |
| 5,916,103 | A * | 6/1999 | Roberts | 52/552 |
| 5,918,426 | A * | 7/1999 | Gifford et al. | 52/97 |
| 5,996,300 | A * | 12/1999 | Hamlin | 52/559 |
| 6,050,042 | A * | 4/2000 | Durachko | 52/557 |
| 6,182,400 | B1 * | 2/2001 | Freiborg et al. | 52/57 |
| 6,581,348 | B2 | 6/2003 | Hunter | |
| 7,036,285 | B2 | 5/2006 | Hunter | |
| 7,124,548 | B2 * | 10/2006 | Pressutti et al. | 52/518 |
| 7,622,187 | B2 | 11/2009 | Clarke | |
| 7,726,086 | B2 | 6/2010 | Kalkanoglu | |
| 7,851,051 | B2 | 12/2010 | DeJarnette | |
| 2002/0053177 | A1 * | 5/2002 | Waggoner et al. | 52/555 |
| 2004/0128929 | A1 * | 7/2004 | Moen | 52/287.1 |
| 2004/0172908 | A1 * | 9/2004 | Swann | 52/518 |
| 2004/0172909 | A1 * | 9/2004 | Gabbard et al. | 52/535 |
| 2005/0055902 | A1 * | 3/2005 | Pressutti et al. | 52/198 |
| 2005/0086890 | A1 * | 4/2005 | Verkamp | 52/518 |

(Continued)

FOREIGN PATENT DOCUMENTS

GB 2401615 A * 11/2004

*Primary Examiner* — Robert Canfield
*Assistant Examiner* — Babajide Demuren
(74) *Attorney, Agent, or Firm* — Jeffrey A. Proehl; Wood, Fuller, Shultz & Smith, P.C.

(57) ABSTRACT

A roofing system and kit including a texture layer for application to an upper surface of the deck of the roof with an upper face of the texture layer being contoured to resemble a different roofing material, a transition texture strip for positioning across gaps between texture layer occurring at transitions in the upper surface of the roof deck and having a contoured upper surface, and an edge strip for application along the perimeter edges of the roof to create an outer perimeter for the roofing system. A finish layer is applied to the texture layer, transition texture strip and edge strip positioned on the roof deck in a liquid sprayable form as a coating onto the texture layer, transition texture strip and edge strip to solidify into a solid layer such that the finish layer forms a continuous membrane over the texture layer, transition texture strip and edge strip.

20 Claims, 8 Drawing Sheets

(56) References Cited

U.S. PATENT DOCUMENTS

| | | | | |
|---|---|---|---|---|
| 2006/0254207 | A1 | 11/2006 | Mulligan | |
| 2007/0074466 | A1 * | 4/2007 | Rasmussen | 52/97 |
| 2007/0209296 | A1 * | 9/2007 | Gage | 52/90.1 |
| 2009/0053529 | A1 | 2/2009 | Kenney | |
| 2009/0241450 | A1 | 10/2009 | Italiane | |
| 2010/0199584 | A1 | 8/2010 | Kalkanoglu | |
| 2010/0212240 | A1 * | 8/2010 | Grubka | 52/309.1 |
| 2010/0218433 | A1 * | 9/2010 | Quaranta et al. | 52/57 |

* cited by examiner

ROOFING SYSTEM AND METHOD

BACKGROUND

Field

The present disclosure relates to roofing systems and more particularly pertains to a new roofing system and method for forming a substantially seamless roof on a structure.

SUMMARY

The present disclosure describes a new roofing system and method which may be utilized to provide a roof that may be virtually seamless, aesthetically similar to other roofing materials, and is suitable for use on roofs with sloped roof decks.

In one aspect, the present disclosure-relates to a roofing system kit for application to a deck of a building structure to form a roof for the structure. The kit may comprise a texture layer for application to an upper surface of the deck of the roof, with the texture layer having a character permitting the layer to be rolled up into a coil prior to installation on a roof and having an upper face being contoured to resemble a different roofing material, the kit may also include a transition texture strip for positioning across gaps between texture layer occurring at transitions in the upper surface of the roof deck, with the transition texture strip being elongated and having a contoured upper surface. The kit may also include an edge strip for application along the perimeter edges of the roof to create an outer perimeter for the roofing system, with the edge strip having an upper surface, an inner edge for orienting toward a center of the roof and an outer edge for orienting away from the center along a portion of the perimeter edge. A ridge may be formed along the outer edge and protruding from the upper surface. The kit may also include a finish layer for application to the texture layer, transition texture strip and edge strip positioned on the roof deck. The finish layer has a liquid sprayable form as a coating onto the texture layer, transition texture strip and edge strip to solidify into a solid layer such that the finish layer forms a continuous, membrane over the texture layer, transition texture strip and edge strip.

In another aspect, the disclosure relates to a roofing system on a deck of a building structure. The roofing system may comprise a texture layer applied to an upper surface of the deck of the roof, with the texture layer having an upper face contoured to resemble a different roofing material. The texture layer may include a plurality of elongate strips. The system may also include a transition texture strip positioned across a gap between the elongate strips of the texture layer occurring at transitions in the upper surface of the roof deck. The transition texture strip may have a contoured upper surface. The system may include an edge strip applied along the perimeter edges of the roof to create an outer perimeter, with the edge strip having an upper surface, a lower surface, an inner edge oriented toward a center of the roof and an outer edge oriented away from the center of the roof and being positioned along a portion of the perimeter edge. A ridge may be formed along the outer edge and protruding from the upper surface. The system may also include a finish layer applied to the texture layer, transition texture strip and edge strip positioned on the roof deck, with the finish layer being applied in a liquid sprayable form as a coating onto the texture layer, transition texture strip and edge strip and solidified into a solid layer such that the finish layer forms a continuous membrane over the texture layer, transition texture strip and edge strip.

In still another aspect, the disclosure relates a method of applying a roofing system to a deck of a roof of a building structure in which the deck has an upper surface, perimeter edges, and at least one transition. The method may include applying a texture layer including a plurality of elongate strips to the upper surface of the deck of the roof, with the elongate strips having an upper face being contoured to resemble a different roofing material. The method may also include positioning a transition texture strip across a gap between elongate strips of the texture layer occurring at transitions in the upper surface of the roof deck, with the transition texture strip having a contoured upper surface. The method may further include mounting an edge strip along the perimeter edges of the roof deck to create an outer perimeter for the roofing system, with the edge strip having an upper surface, a lower surface, an inner edge and an outer edge, a ridge being formed on the upper surface along the outer edge and protruding from the upper surface. The method may include spraying a liquid finish layer onto the texture layer, transition texture strip and edge strip positioned on the roof deck to coat the texture layer, transition texture strip and edge strip, and allowing the liquid finish layer to solidify on the texture layer, transition texture strip and edge strip so as to provide a continuous membrane over the texture layer, transition texture strip and edge strip.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
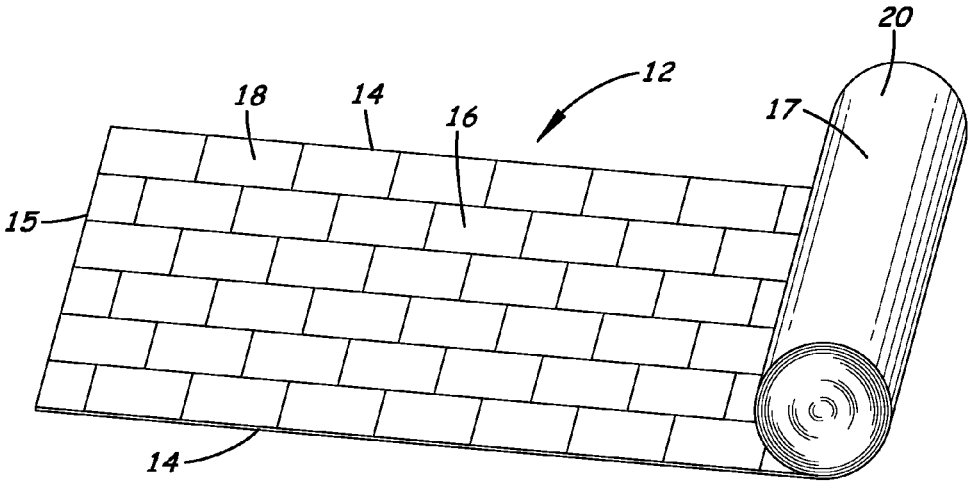
FIG. 1 is a schematic perspective view of a partially coiled elongate panel of the texture layer of the new roofing system according to the present disclosure.
Figure 2:
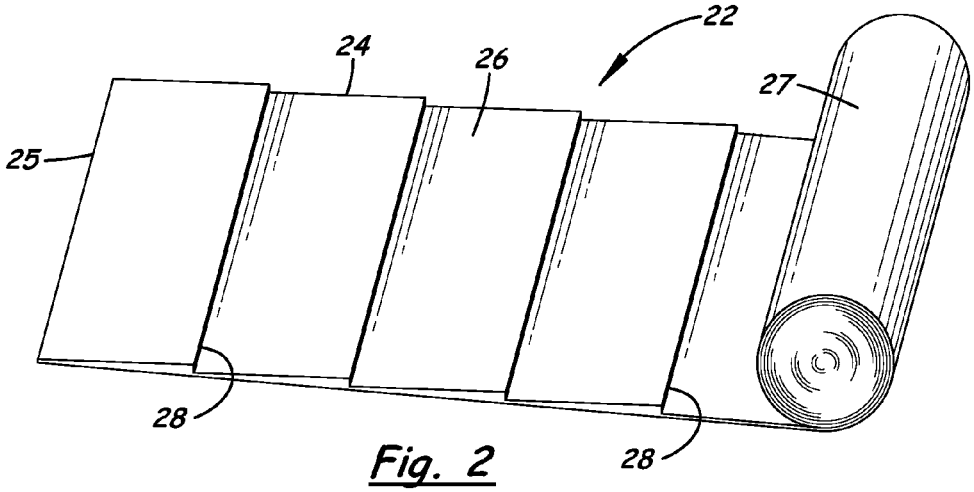
FIG. 2 is a schematic perspective view of a partially coiled transition texture strip of the roofing system, according to an illustrative embodiment.
Figure 3:
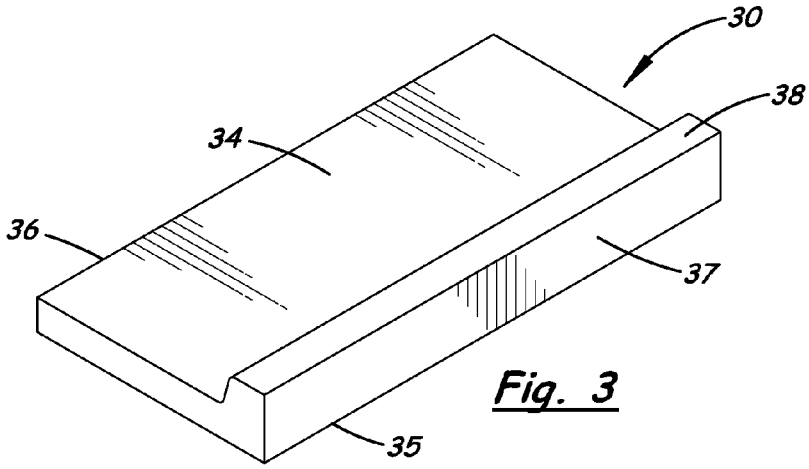
FIG. 3 is a schematic perspective view of an edge strip of the roofing system, according to an illustrative embodiment.
Figure 4:
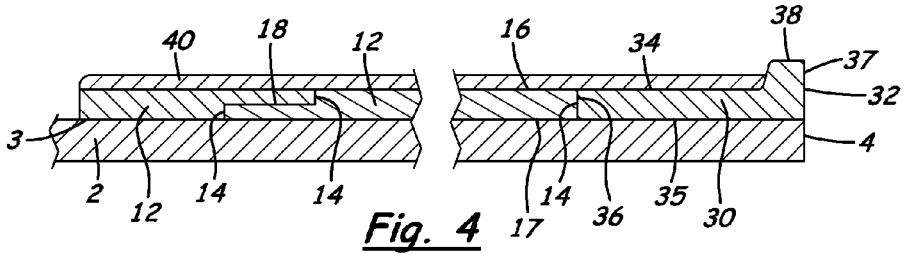
FIG. 4 is a schematic sectional view of a portion of the roofing system in an illustrative installed configuration.
Figure 5:
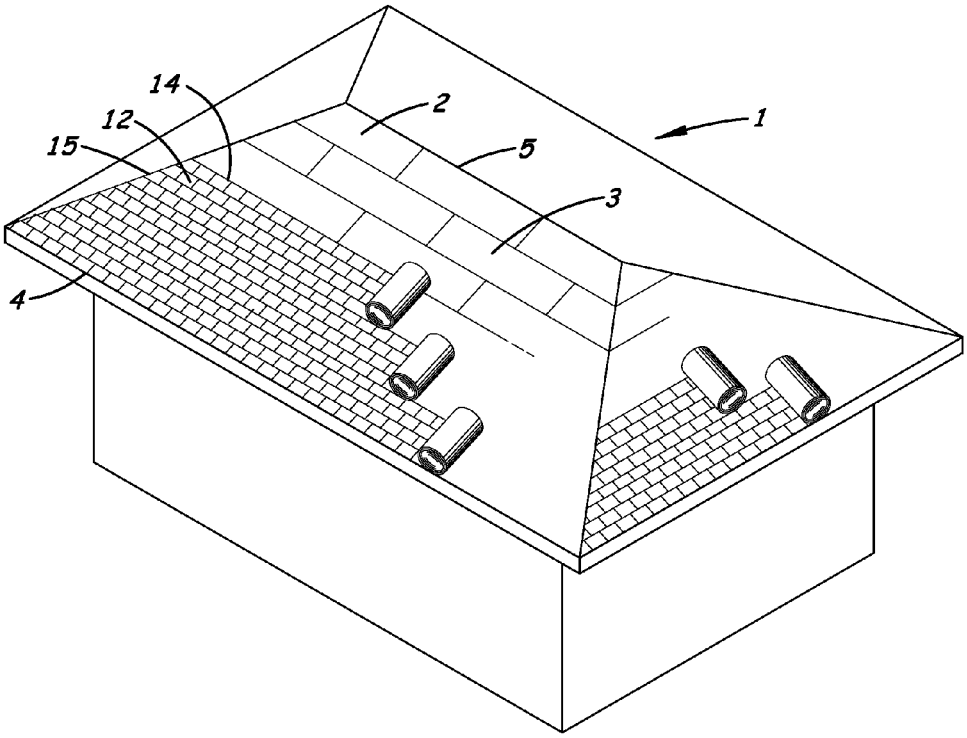
FIG. 5 is a schematic perspective view of the roof deck of a structure that is partially covered by panels of the texture layer, according to an illustrative embodiment.
Figure 6:
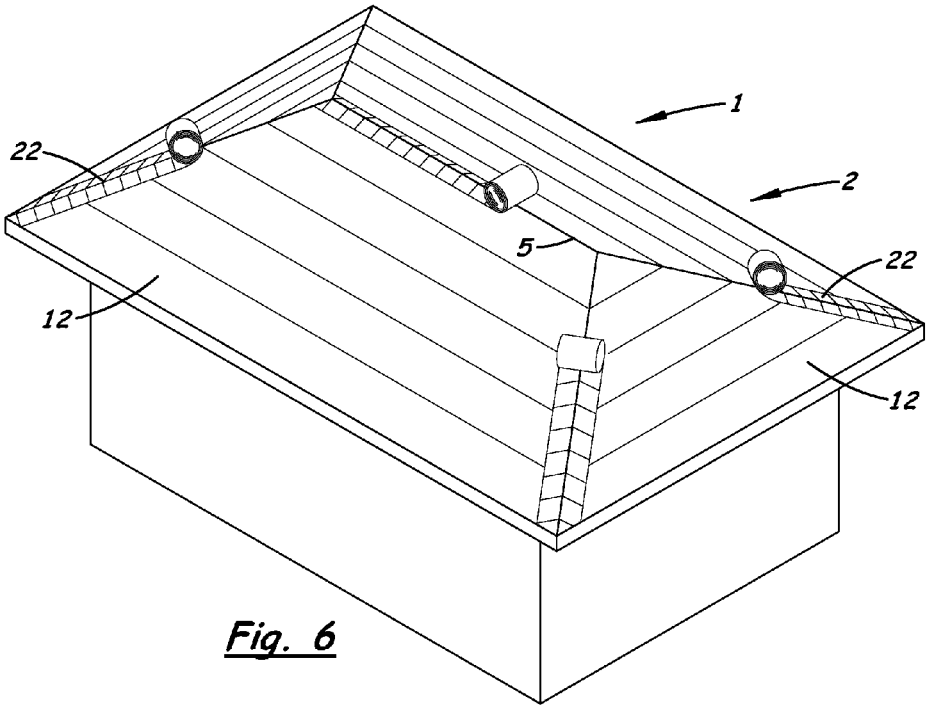
FIG. 6 is a schematic perspective view of the roof deck having the texture layer installed and portions of the ridge and hips covered by the transition texture strips, according to an illustrative embodiment.
Figure 7:
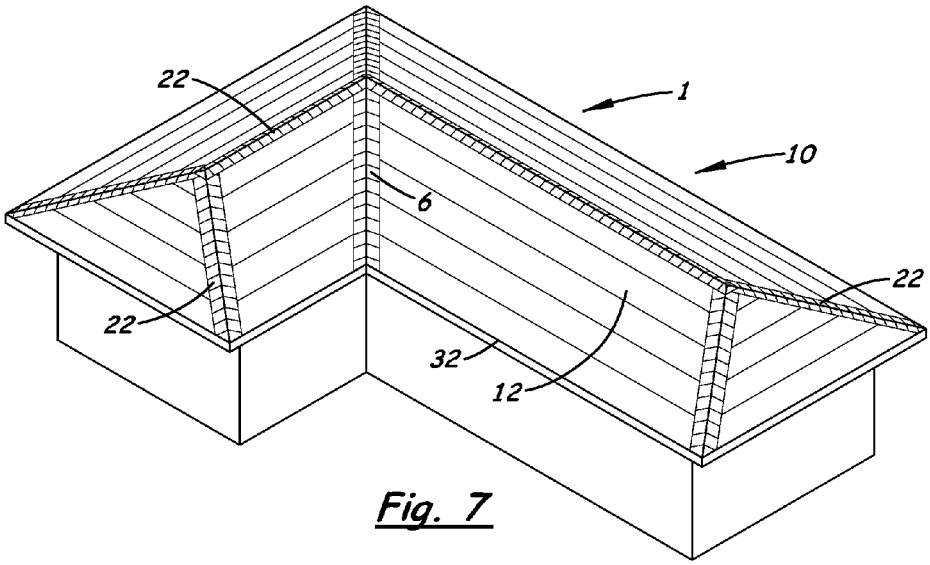
FIG. 7 is a schematic perspective view of an implementation of the roofing system applied to a roof deck having ridges, hips and valleys covered by transition texture strips, according to an illustrative embodiment.
Figure 8:
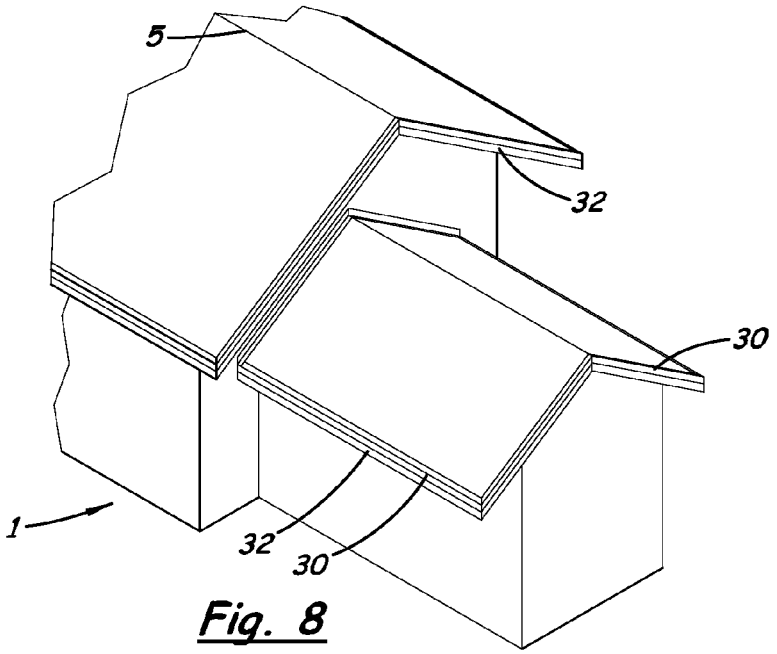
FIG. 8 is a schematic perspective view of the roof deck of s structure with the edge strip applied along perimeter edges of the roof deck.
Figure 9:
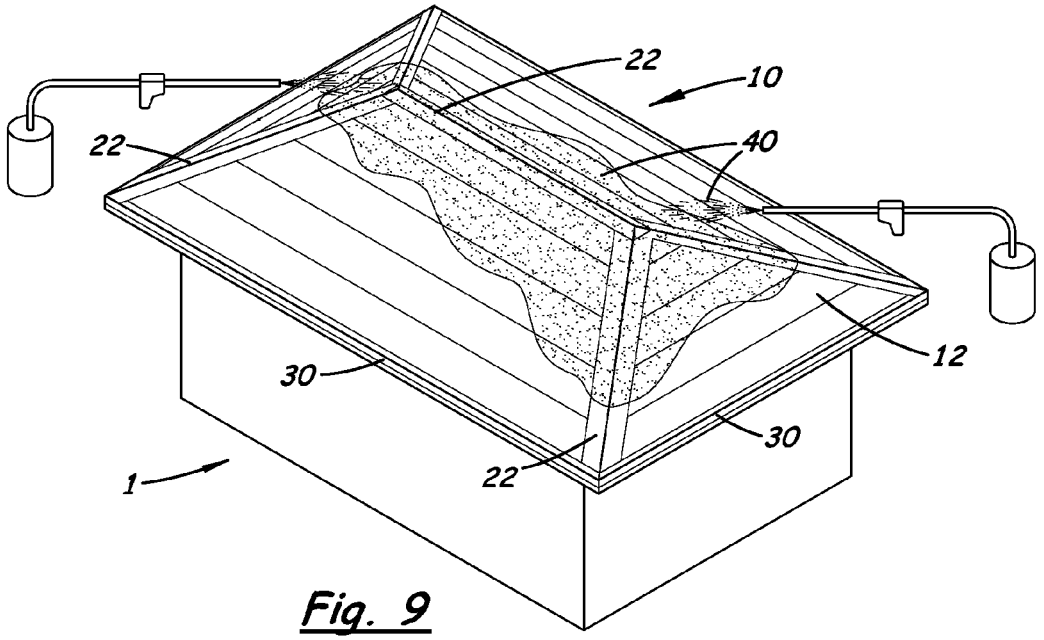
FIG. 9 is a schematic perspective view of the texture layer, transition texture strips, and edge strips applied with the material of the finish layer being applied.
Figure 10:
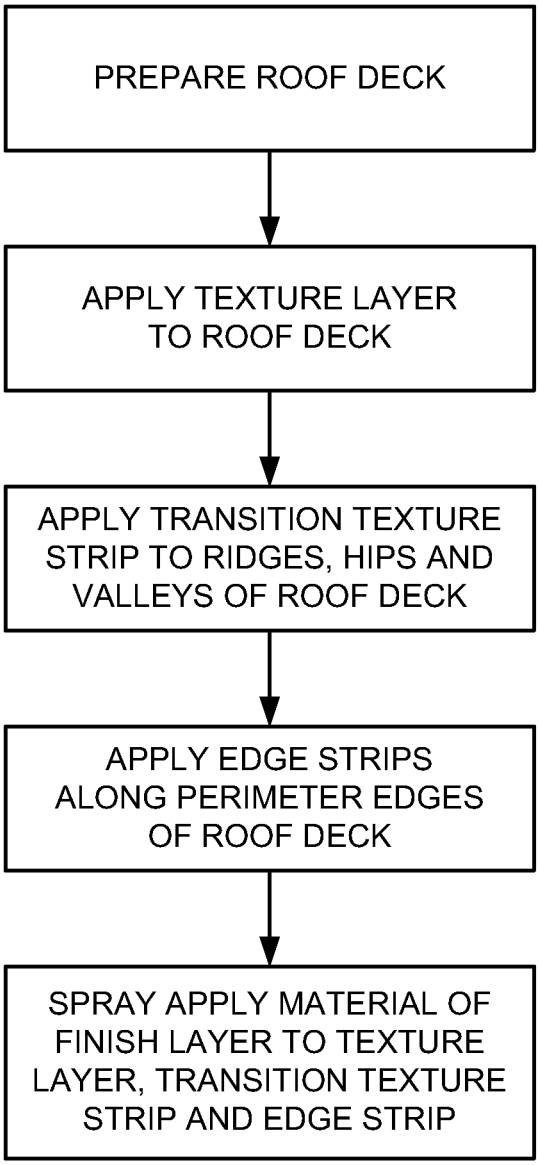
FIG. 10 is a schematic flow diagram of one portion of an illustrative implementation of a process of forming a roof of the disclosure.
Figure 11:
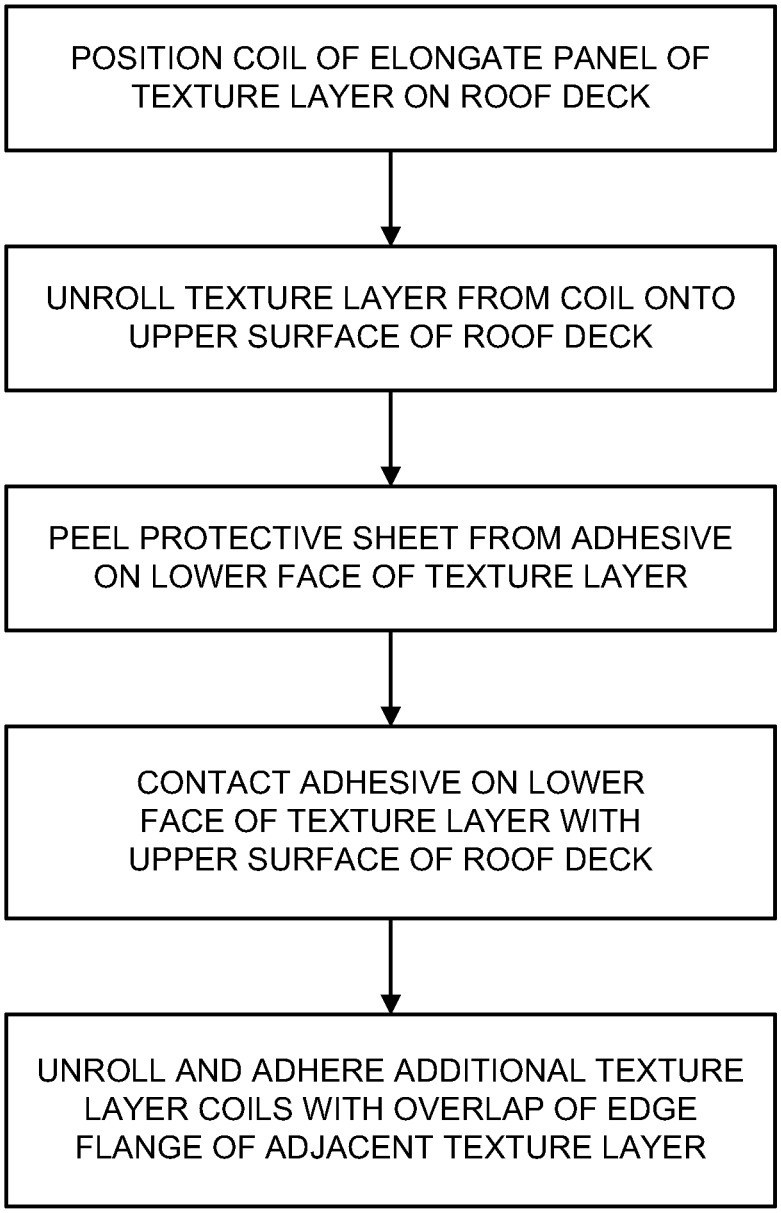
FIG. 11 is a schematic flow diagram of another portion of an illustrative implementation of a process of forming a roof of the disclosure.
Figure 12:
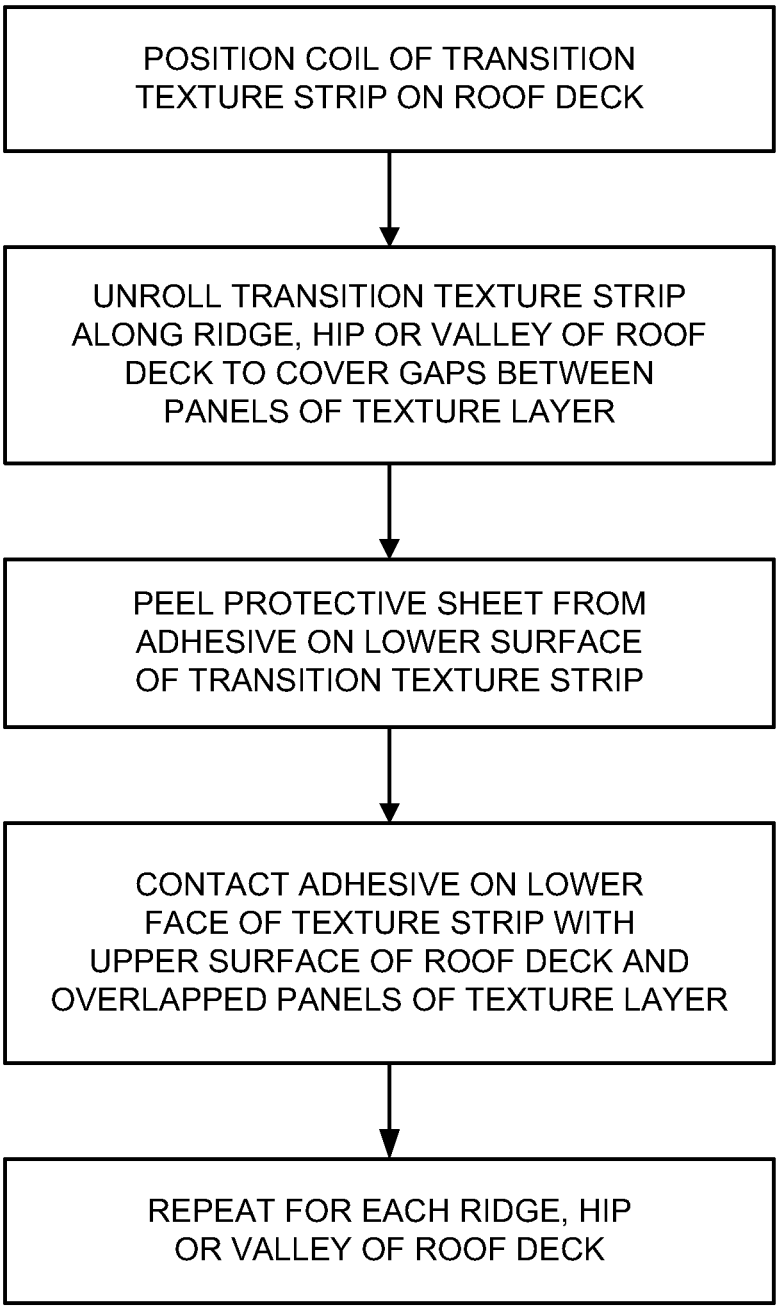
FIG. 12 is a schematic flow diagram of yet another portion of an illustrative implementation of a process of forming a roof of the disclosure.
Figure 13:
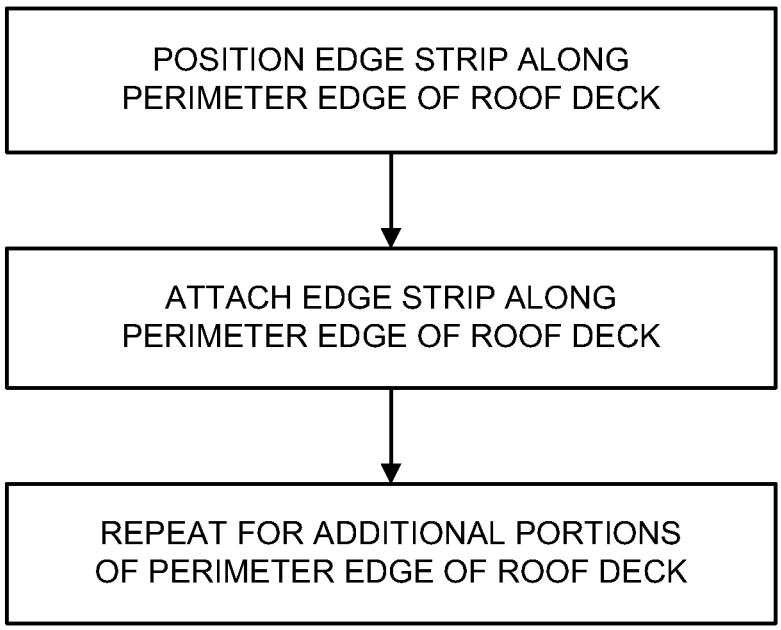
FIG. 13 is a schematic flow diagram of still yet another portion of an illustrative implementation of a process of forming a roof of the disclosure.

With reference now to the drawings, and in particular to FIGS. 1 through 13 thereof, a new roofing system and method embodying the principles and concepts of the disclosed subject matter will be described.

In some aspects of the disclosure, a roofing system 10 will be described that is highly suitable for forming a roof on a building structure 1, such as on the roof deck 2 of the structure. The deck 2 has an upper surface 3 and perimeter edges 4. The roof deck 2 may have portions that lie in different planes that intersection with each other, and may form at least one ridge or peak 5 and may also form at least one valley 6.

The roofing system 10 may comprise a texture layer 12 for application to the upper surface 3 of the roof deck. In some embodiments, the texture layer 12 has opposite longitudinal side edges 14 and opposite end edges 15 and forms an elongated panel that may be applied in broad strips to the upper surface 3 of the roof deck. The elongated panel of the texture layer 12 may be rolled or coiled into a more compact form for delivery to the site of the building structure, and thus the texture layer may have a degree of flexibility that permits the coiling of the panel. However, this flexible character is not critical to the function of the texture layer, and the layer 12 could be provided in a stack of relatively flat panels. The coilable form of the texture layer 12 may provide the ability to utilize longer lengths of the panel of the layer 12 for being applied to the roof deck, and thus may reduce the number of joints or junctures in the texture layer. Despite the ability to coil the elongated panel of the texture layer, the layer may have a relatively thick character with a thickness that ranges between approximately ⅛ inches and approximately ⅜ inches. Illustratively, the width of the texture layer 12 between the longitudinal side edges 24 may range between approximately 30 inches and approximately 48 inches, although the width may vary from this range. In one illustrative embodiment, the elongate panel of the texture layer 12 has a length of approximately 50 feet and a width of approximately 3 feet.

The texture layer 12 has an upper face 16 that is oriented upwardly when the layer 12 is applied to the roof deck, and has a lower face 17 that is oriented downwardly toward the roof deck and may be positioned against the upper surface 3 of the roof deck when installed. In some of the most preferred embodiments of the roofing system 10, the upper face 16 of the texture layer 12 is contoured. The contouring of the upper face contributes to an appearance that is different than, for example, regular rolled roofing material with a substantially flat or planar face. The contouring may provide an appearance that resembles or reproduces to some degree the texture or shape of a more conventional roofing material, such as wood shingles or shakes, composite shingles, and even clay tiles or slate or other materials. In some of these embodiments, the upper face 16 has a plurality of rows of similar contours that extend substantially parallel to the longitudinal edges 14. The rows of contours may comprise, for example, alternating raised areas and sunken areas of the upper face 16 which may serve to approximate the appearance of a series of rows of shingles. The contouring of the upper face 16 may have various shapes and sizes, depending upon the appearance of the roofing material to be represented.

In some embodiments, the texture layer has an edge flange 18 extending along at least one of the longitudinal edges 14 to be overlapped by an adjacent panel of the texture layer. The portion of the upper face 16 located on the edge flange 18 may be substantially flat, and the portion of the texture layer forming the edge flange may have a thickness that reduced and thinner than the rest of the texture layer. In some illustrative embodiments, the edge flange has a width of approximately 2 inches.

Optionally, an adhesive 20 may be applied to the lower face 17 of the texture layer to directly adhere the texture layer to the upper surface 3 of the roof deck without use of discrete fasteners such as nails. As a further option, the adhesive on the lower face may be covered by a protective sheet that is removable prior to positioning of the texture layer to the roof deck. While discrete fasteners may be used to attach the texture layer to the roof deck, such an implementation is less advantageous due to the possibility of puncturing the finish layer 40 described below.

The roofing system 10 may also include a transition texture strip 22 for positioning across gaps between portions of the texture layer 12 that may be present at, for example, transitions in the upper surface 3 of the roof deck. These transitions may occur at valleys, ridges, and hips of the roof deck. The transition texture strip 22 may partially overlap portions of pieces of the texture layer 12, although abutment of the edges may be utilized. The transition texture strip 22 is preferably formed of a material that is sufficiently flexible to bend over a ridge or hip of a roof deck, as well as into the valley of the roof deck.

The transition texture strip 22 may be elongated in character with side edges 24 and end edges 25, although typically the transition texture snips are narrower than the elongated panels of the texture layer 12. Illustratively, the width of the transition texture strip 22 between the side edges 24 may range between approximately 8 inches and approximately 16 inches, although other widths may be employed. In some illustrative embodiments, the texture strip has a width of approximately 12 inches.

The transition texture strip 22 has an upper surface 26 which may be contoured. In some embodiments, the upper surface has a plurality of transverse ledges 28 which may extend from one side edge 24 of the strip 22 to the opposite side edge 24 of the strip. The transverse ledges 28 may each be bounded on one side by a minimum thickness of the texture strip 22 and may be bounded on another side by a maximum thickness of the texture strip so that the contour of the upper surface 26 replicates the appearance of stacked, staggered shingles. Other contours may be used.

Adhesive may also be applied to the lower surface 27 of the transition texture strip 22 and may also be protected by a protective panel or membrane that may be removed prior to application of the strip 22 to the roof deck 2.

The roofing system 10 may also include an edge strip 30 for application along the perimeter edges 4 of the roof to create an outer perimeter 32 for the installed roofing system. The edge strip 30 has an upper surface 34 and a lower surface 35 for positioning downwardly toward the upper surface 3 of the roof deck. The edge strip 30 has an inner edge 36 for orienting toward a center of the roof and an outer edge 37 for orienting away from the center of the roof. The outer edge 37 of the edge strip may be positioned along a portion of the perimeter edge 4 of the roof deck such that the outer perimeter 32 of the roofing system generally corresponds to the perimeter edge of the roof deck. The edge strip 30 may have a ridge or rim 38 formed along the outer edge 37 of the strip 30 that protrudes from the upper surface 34 in an upward direction when the edge strip is installed on a roof deck. The edge strip 30 may have a width that is in the range of approximately 1 inches to approximately 4 inches, and in one illustrative embodiment has a width of approximately 4 inches.

The roofing system 10 may also include a finish layer 40 that may be applied to the texture layer 12, transition texture strip 22 and edge strip 30 when those elements are positioned or mounted on the roof deck 2. In the most preferred embodiments, the finish layer 40 forms a continuous membrane across the texture layer 12, any transition texture strips, and edges strips that are installed on the roof deck, without having any gaps or openings or other air- or water-permeable openings across those elements. The finish layer 40 thus extends across the joints or abutted edges between the elements 12, 22 and 30.

In the most preferred and advantageous embodiments of the system 10, the finish layer 40 is applied to the texture layer 12, and any transition texture strips 22 and edge strips 40 in a liquid sprayable form as a coating onto the elements 12, 22 and 30 to set up as a solid layer of continuous material. Thus, the sprayable liquid form of the material of the finish layer 40 may dry or cure or make another type of transition from the vapor or liquid state to the solid state to create the finish layer.

The sprayable material preferably has flexibility after solidification and is not rigid in character, although the material is no longer flowable once it has set up to a solid state. Further, the preferred sprayable material bonds to the underlying material of the texture layer 12, any transition texture strips 22 and any edge strips 40 onto which it sprayed without separating from those materials. Some highly suitable materials for forming the finish layer are materials resembling or having similar characteristics of a polyurea or synthetic material that may be elastic in its maneuverable properties.

In another aspect of the disclosure, a method of forming the roofing system will be described (see FIGS. 10 through 13. Initially, any necessary preparation of the upper surface of the roof deck may be performed such as removal of any debris that might interfere with the adhesion of the materials of the roofing system to the roof deck where adhesion is being utilized to hold the system to the roof deck. The method may further include the application of the elongate panels of the texture layer to the roof deck, application of the transition texture strips to the roof deck, application of the edge strips along the perimeter edges of the roof deck, and then spray application of the material of the finish layer to the texture layer, transition texture strips, and edge strips. In some implementations of the method, the edge strips may be applied to the roof deck prior to or in conjunction with the application of the texture layer and/or the transition texture strip.

In greater detail, the application of the texture layer to the roof deck may include positioning a coil of the elongate panel of the texture layer on the roof deck, such as on a lower region of the roof deck, and uncoiling or unrolling the elongate panel onto the upper surface of the roof deck in an orientation so that the longitudinal axis of the elongate panel extends substantially parallel to the portion of the perimeter edge located at the lower region of the roof deck. In connection with the unrolling of the elongate panel, any protective sheet present on the texture layer to protect the adhesive may be peeled away and removed as the panel is unrolled, and the lower face with the adhesive brought into contact with the upper surface of the roof deck. Trimming or cutting of the texture layer may be needed to conform the shape of the panel to the shape of the roof deck. The ends of the elongate panel may thus be configured to extend up to, but not beyond and over, the ridges, hips and valleys or other transitions in the shape of the roof.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A roofing system kit for application to a deck of a building structure to form a roof for the structure, the kit comprising:

a texture layer for application to an upper surface of the deck of the roof, the texture layer having a character permitting pieces of the texture layer to be rolled up into a coil prior to installation on a roof and unrolled onto the deck of the building, the texture layer having an upper face being contoured;

a transition texture strip for positioning across gaps between pieces of the texture layer occurring at transitions in the upper surface of the roof deck, the transition texture strip being elongated and having a contoured upper surface with a plurality of ledges extending transverse to a length of the texture strip and being formed by a gradual increase in a thickness of the strip from one said ledge to a next adjacent ledge;

an edge strip for application along the perimeter edges of the roof to create an outer perimeter for the roofing system, the edge strip having an upper surface, an inner edge for orienting toward a center of the roof and an outer edge for orienting away from the center along a portion of the perimeter edge, a ridge being formed along the outer edge and protruding upwardly from the upper surface; and a finish layer for application to the texture layer, transition texture strip and edge strip positioned on the roof deck, the finish layer having a liquid sprayable form as a coating onto the texture layer, transition texture strip and edge strip to solidify into a solid layer such that the finish layer forms a continuous membrane over the texture layer, transition texture strip and edge strip.

2. The kit of claim 1 wherein the upper face of the texture layer has a plurality of rows of contours extending substantially parallel to the longitudinal edges.

3. The kit of claim 2 wherein the rows of contours in the texture layer are formed by areas of the upper face of relatively different heights including alternating raised areas of the upper face and sunken areas of the upper face.

4. The kit of claim 1 wherein an adhesive is applied to a lower face of the texture layer to directly adhere the texture layer roll to the upper surface of the deck of the roof without use of discrete fasteners.

5. The kit of claim 1 wherein the texture layer has an edge flange along a longitudinal edge of the elongate strip for being overlapped by an adjacent piece of texture layer, the upper face of the edge flange having a substantially flat surface, a thickness of the texture layer being reduced on the edge flange.

6. The kit of claim 1 wherein the transverse ledges of the texture strip each extend from one side edge of the strip to another side edge of the strip.

7. The kit of claim 1 wherein each of the transverse ledges is bounded on one side of the ledge by a minimum thickness of the texture strip and is bounded on another side of the ledge by a maximum thickness of the texture strip.

8. The kit of claim 1 wherein the sprayable liquid dries to create the finish layer.

9. The kit of claim 1 wherein the sprayable liquid cures to create the finish layer.

10. The kit of claim 1 including a plurality of pieces of the texture layer, a plurality of pieces of the transition texture strip, and a plurality of pieces of the edge strip.

11. A roofing system on a deck of a building structure, the roofing system comprising:

a texture layer applied to an upper surface of the deck of the roof, the texture layer having an upper face contoured with a plurality of rows of contours, the rows of contours in the texture layer being formed by areas of the upper face of relatively different heights including alternating raised areas of the upper face and sunken areas of the upper face, the texture layer including a plurality of elongate strips;

a transition texture strip positioned across a convergence of a pair of the elongate strips of the texture layer occurring at transitions in the upper surface of the roof deck, the transition texture strip having a contoured upper surface with a plurality of ledges extending transverse to a length of the texture strip in a repeating manner along the length and being formed by a gradual increase in a thickness of the strip from one said ledge to a next adjacent ledge;

an edge strip applied along the perimeter edges of the roof to create an outer perimeter, the edge strip having an upper surface, a lower surface, an inner edge oriented toward a center of the roof and an outer edge oriented away from the center of the roof and being positioned along a portion of the perimeter edge, a ridge being formed along the outer edge and protruding from the upper surface; and a finish layer applied to the texture layer, transition texture strip and edge strip positioned on the roof deck, the finish layer being applied in a liquid sprayable form as a coating onto the texture layer, transition texture strip and edge strip and solidified into a solid layer such that the finish layer forms a continuous membrane over the texture layer, transition texture strip and edge strip.

12. The system of claim 11 wherein the plurality of rows of contours extend substantially parallel to the longitudinal edges.

13. The system of claim 11 wherein an adhesive is applied to a lower face of the texture layer to directly adhere the texture layer roll to the upper surface of the deck of the roof without use of discrete fasteners.

14. The system of claim 11 wherein the transverse ledges of the texture strip extend from one side edge of the strip to another side edge of the strip.

15. The kit of claim 1 wherein no portion of the ridge of the edge strip extends over the upper surface of the edge strip.

16. A roofing system kit for application to a deck of a building structure to form a roof for the structure, the kit comprising:

a texture layer for application to an upper surface of the deck of the roof, the texture layer having a character permitting pieces of the texture layer to be rolled up into a coil prior to installation on a roof and unrolled onto the deck of the building, the texture layer having an upper face being contoured with a plurality of rows of contours extending substantially parallel to the longitudinal edges, the rows of contours in the texture layer being formed by areas of the upper face of relatively different heights including alternating raised areas of the upper face and sunken areas of the upper face;

a transition texture strip for positioning across gaps between pieces of the texture layer occurring at transitions in the upper surface of the roof deck, the transition texture strip being elongated and having a contoured upper surface with a plurality of ledges extending transverse to a length of the texture strip and being formed by a gradual increase in a thickness of the strip from one said ledge to a next adjacent ledge such each of the transverse ledges is bounded on one side of the ledge by a minimum thickness of the texture strip and is bounded on another side of the ledge by a maximum thickness of the texture strip;

an edge strip for application along the perimeter edges of the roof to create an outer perimeter for the roofing system, the edge strip having an upper surface, an inner edge for orienting toward a center of the roof and an outer edge for orienting away from the center along a portion of the perimeter edge, a ridge being formed along the outer edge and protruding upwardly from the upper surface; and a finish layer for application to the texture layer, transition texture strip and edge strip positioned on the roof deck, the finish layer having a liquid sprayable form as a coating onto the texture layer, transition texture strip and edge strip to solidify into a solid layer such that the finish layer forms a continuous membrane over the texture layer, transition texture strip and edge strip.

17. The kit of claim 16 wherein an adhesive is applied to a lower face of the texture layer to directly adhere the texture layer roll to the upper surface of the deck of the roof without use of discrete fasteners.

18. The kit of claim 16 wherein the transverse ledges of the texture strip each extend from one side edge of the strip to another side edge of the strip.

19. The kit of claim 16 including a plurality of pieces of the texture layer, a plurality of pieces of the transition texture strip, and a plurality of pieces of the edge strip.

20. The kit of claim 16 wherein no portion of the ridge of the edge strip extends over the upper surface of the edge strip.

* * * * *